US007198522B1

(12) United States Patent
Ho et al.

(10) Patent No.: US 7,198,522 B1
(45) Date of Patent: Apr. 3, 2007

(54) PLUG CONNECTOR

(75) Inventors: Hsin-tsung Ho, Tu-Cheng (TW); Yu-hung Su, Tu-Cheng (TW); Chung-hsin Huang, Tu-Cheng (TW); Mei-chuan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/585,158

(22) Filed: Oct. 24, 2006

(51) Int. Cl.
*H01R 24/00* (2006.01)

(52) U.S. Cl. ..... 439/660; 439/353

(58) Field of Classification Search ..... 439/350, 439/351, 352, 353, 660
See application file for complete search history.

(56) References Cited

U.S. PATENT DOCUMENTS 5,011,424 A * 4/1991 Simmons ..... 439/352
5,234,357 A * 8/1993 Yamaguchi ..... 439/354
6,830,469 B1 * 12/2004 Doyle et al. ..... 439/247
6,976,876 B1 * 12/2005 Su et al. ..... 439/607
7,048,558 B2 * 5/2006 Fan ..... 439/157

* cited by examiner

*Primary Examiner*—James R. Harvey
*Assistant Examiner*—Travis Chambers
(74) *Attorney, Agent, or Firm*—Rosenberg, Klein & Lee

(57) ABSTRACT

A plug connector includes plastic covers, a mating portion and a latch. The plastic covers include an upper plastic cover and a lower plastic cover, the two plastic covers buckling with each other and forming a space. The mating portion which is fixed in the space includes a shell. A hook aperture is located on the front of the shell. The latch, which is fixed into the space, has two barricades. Each barricade stretches forward and forms an arm. Each arm has a hook at its head. The hooks pass through the hook apertures and project outwardly, wherein each barricade of the latch protrudes upward and forms a locating bulge. Correspondingly two locating cavities are defined inside the top surface of the upper plastic cover. The locating bulges are inset into the locating cavities.

11 Claims, 6 Drawing Sheets

PLUG CONNECTOR

BACKGROUND OF THE INVENTION

1. Field of the Invention

The present invention relates to a plug connector, and particularly to a plug connector which prevents itself from loosening when connection is established.

2. The Related Art

As the development of computer technology, the employment of a USB plug connector is becoming an important way to connect a computer host with a peripheral equipment.

Traditionally, the USB plug connector with a latching device includes a shell which receives a plurality of conductor pins, plastic covers and a cable. The plastic covers include an upper plastic cover and a lower plastic cover. The two plastic covers buckle with each other and define a space therebetween. The shell is received in the space and stretches out of the front of the plastic covers. The latch which is placed in the space has a pair of barricades. The two barricades stretch forward and form two arms. Each arm has a hook at the head. The hooks project themselves outwardly from the front sides of the shell. The cable is connected to the rear of the latch.

However, there is no fixing device between the plastic covers and the latch, so the interior of the USB plug connector tends to loosing when the USB plug connector is pulled out in a strong force or used too often. Therefore it leads to loosing between the USB plug connector and a socket connector and sometimes even destroys the USB plug connector.

SUMMARY OF THE INVENTION

It is an object of the present invention to provide a plug connector having a steady device of a latch so that the plug connector is used securely.

To achieve the above object, the plug connector includes plastic covers, a mating portion and a latch. The plastic covers include an upper plastic cover and a lower plastic cover and the two plastic covers buckle with each other and form a space. A mouth is opened in a front of a plastic cover plank. The mating portion, which is fixed into the space, stretches out of the mouth. The mating portion includes a plurality of conductor pins, a housing and a shell. The conductor pins are inserted into the housing and then the housing is held in the shell. A hook aperture is opened in the front side of each shell. Latch, which is fixed into the space, has two barricades. The two barricades stretch forward and form two arms. Each arm has a hook at the head. The hooks are inserted into the hook apertures and project themselves outside. Wherein the barricades of the latch protrude upward and form at least two locating bulges. Correspondingly at least two locating cavities are defined in the inner of the top surface of the upper plastic cover. The locating bulges are inset into the locating cavities.

In terms of above description, the object is realized by the locating bulges inset into the locating cavities. This advantage of the present invention assures that the plug connector is used securely and steadily.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENTS

Figure 1:
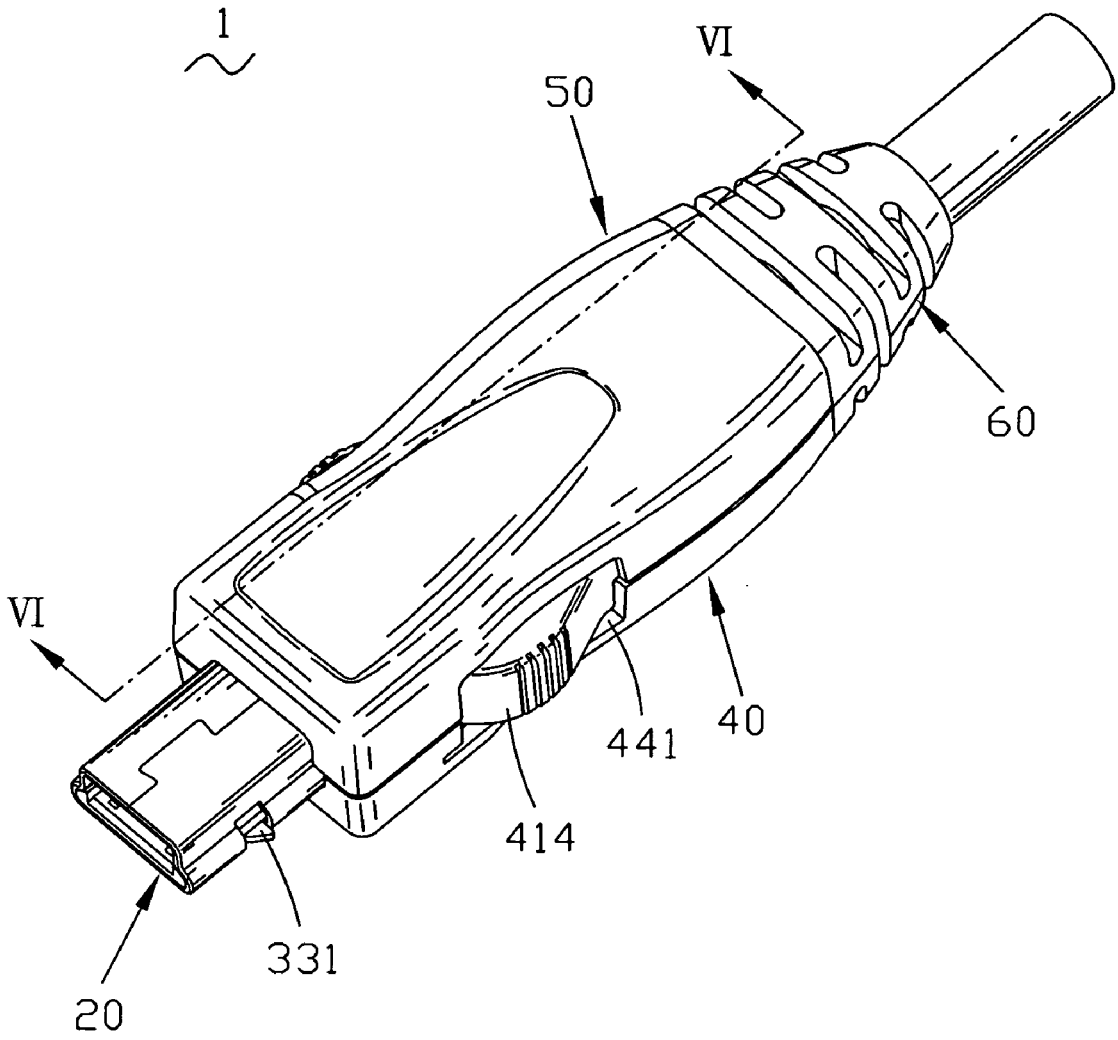
FIG. 1 is a perspective view of a plug connector in accordance with the present invention.
Figure 2:
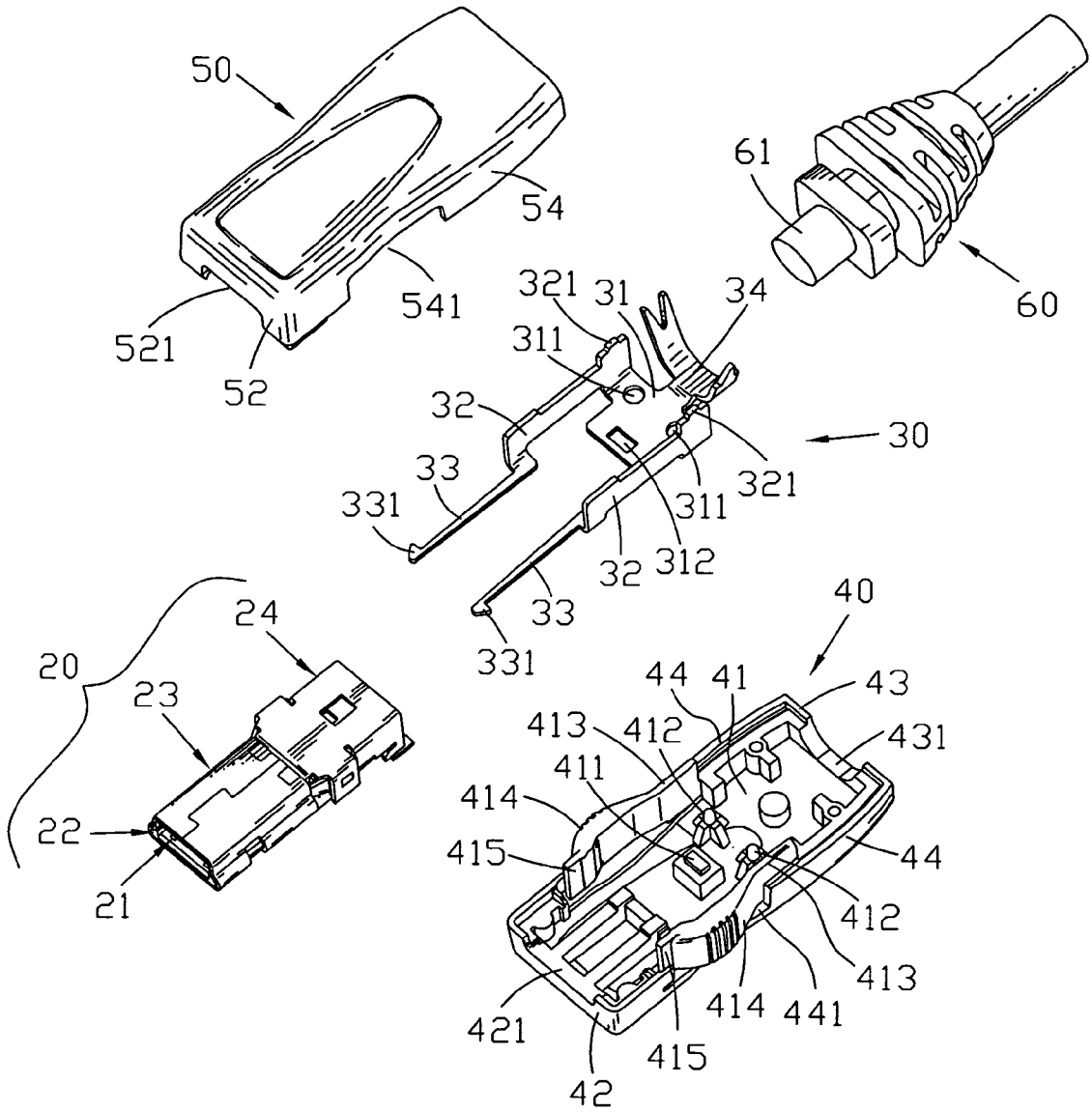
FIG. 2 is an exploded view of the plug connector shown in FIG. 1.

Referring to FIGS. 1 to 2, a plug connector 1 is a USB plug connector. The plug connector 1 according to the present invention includes a mating portion 20, a latch 30, plastic covers and a cable 60. The plastic covers further include an upper plastic cover 50 and a lower plastic cover 40 and the two plastic covers buckle with each other and define a space. The mating portion 20 and the latch 30 are set into the space with the mating portion 20 stretching out of the front part of the plastic covers. The cable 60 is connected with the rear of the latch 30.

Figure 3:
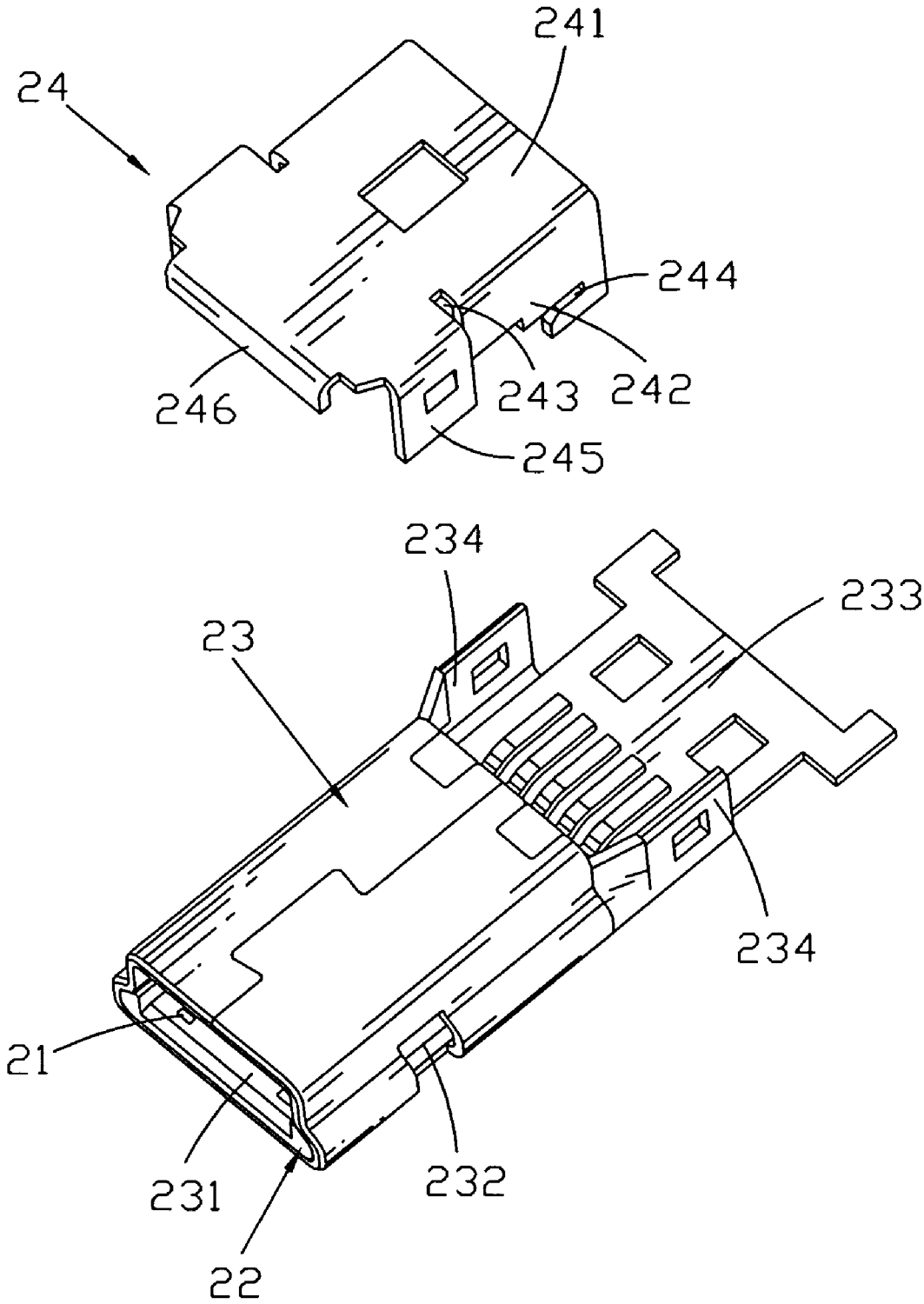
FIG. 3 is a detailed exploded view of a mating portion of the plug connector.

Referring to FIG. 3, the mating portion 20 of the plug connector 1 includes a plurality of conductor pins 21, a housing 22, a front shell 23 and a back shell 24. The conductor pins 21 are inserted into the housing 22. The front shell 23 further forms an accepting body 231 for accommodating the housing 22. The front of each side of the accepting body 231 opens a hook aperture 232. The rear of the front shell 23 extends backward and forms a bottom board 233. The back of the sidewall of the front shell 23 also stretches backward and forms a block 234. The back shell 24 has a top board 241. Each back of the side of the top board 241 bends vertically and forms a first sideboard 242. At each front of the first sideboard 242, an opening bar 243 is defined. Each rear of the first sideboard 242 stretches downward and extends forward and then forms a latch arm 244. Each front of the side of the top board 241 stretches sideward and then bends vertically to form a second sideboard 245. The front edge of the top board 241 bends vertically and forms a front preventing board 246. The latch arms 244 of the back shell 24 buckle with the rear of the bottom board 233 of the front shell 23. The second sideboards 245 buckle with the outer surface of the blocks 234. The front preventing board 246 contacts with the rear of the front shell 23.

Referring to FIG. 2, the latch 30 has a basic board 31. Two circle preventing holes 311 are opened in the end of the basic board 31 and a square limiting hole 312 is opened in the middle of the front of the basic board 31. Each side of the basic board 31 stretches upward and forms a barricade 32. Both of the barricades 32 extend forward to the front of the basic board 31. Each barricade 32 protrudes upward and forms a locating bulge 321 in tear. The barricade 32 extends sidelong a bit and then stretches forward, forming an arm 33. The arm 33 protrudes outward and forms a hook 331 at the head. At the middle of the rear of the basic board 31, the basic board 31 stretches backward and forms an immovable slice 34, which is bent upward.

Referring to FIG. 2 again, the lower plastic cover 40 includes a basic plank 41, a front plank 42, a back plank 43 and two side planks 44. In the middle of the front plank 42 a front mouth 421 is opened. In the middle of the basic plank 41, the basic plank 41 stretches upward and forms a restricting bulge 411. The basic plank 41 also stretches upward and forms two blocking pillars 412 behind the restricting bulge 411. The back plank 43 defines a back mouth 431. Each side plank 44 either defines a button mouth 441. Behind each button mouth 441, the basic plank 41 protrudes upward and forms a steady board 413 which is close to the inner surface of each side plank 44. The front section of each steady board 413 extends forward and forms a resilient button 414. Each resilient button 414 bulges out of the button mouth 441 and also stretches forward and then forms a touching board 415. The touching board 415 contacts with the inner surface of each side plank 44.

Figure 4:
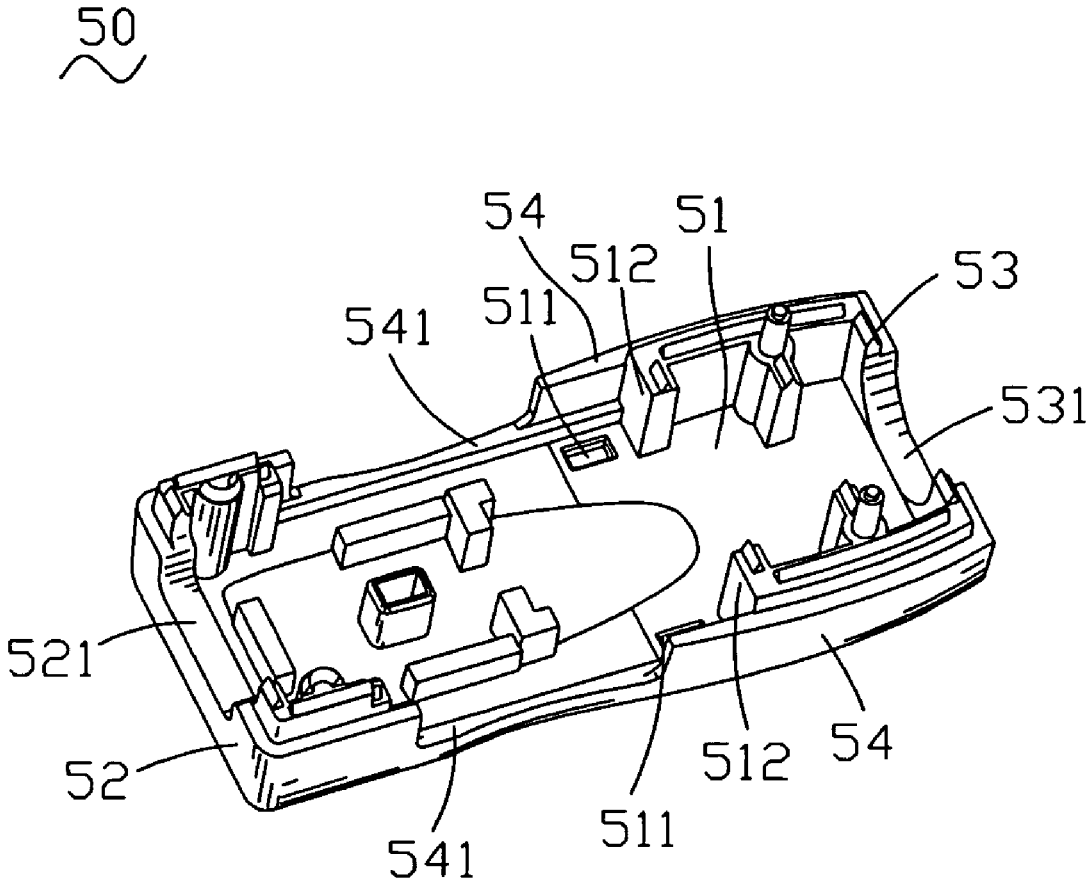
FIG. 4 is a perspective view of an upper plastic cover of the plug connector.

Referring to FIG. 4, the upper plastic cover 50 includes a top wall 51, a front wall 52, a back wall 53 and two sidewalls 54. A front opening 521 is defined in the front wall 52 to match up with the front mouth 421 of the lower plastic cover 40. The top wall 51 defines two locating cavities 511 near the two sidewalls 54. There are withstanding boards 512 behind the locating cavities 511. Both of the withstanding boards 512 are connected with the two sidewalls 54. A back opening 531 is defined in the back wall 53 and matches up with the back mouth 431 of the lower plastic cover 40. A button opening 541 which matches the button mouth 441 of the lower plastic cover 40 is defined in each sidewall 54.

The cable 60 is placed in the rear of the plastic covers and has a plurality of conductive leads 61 (not shown) respectively connecting with the conductor pins 21.

Figure 5:
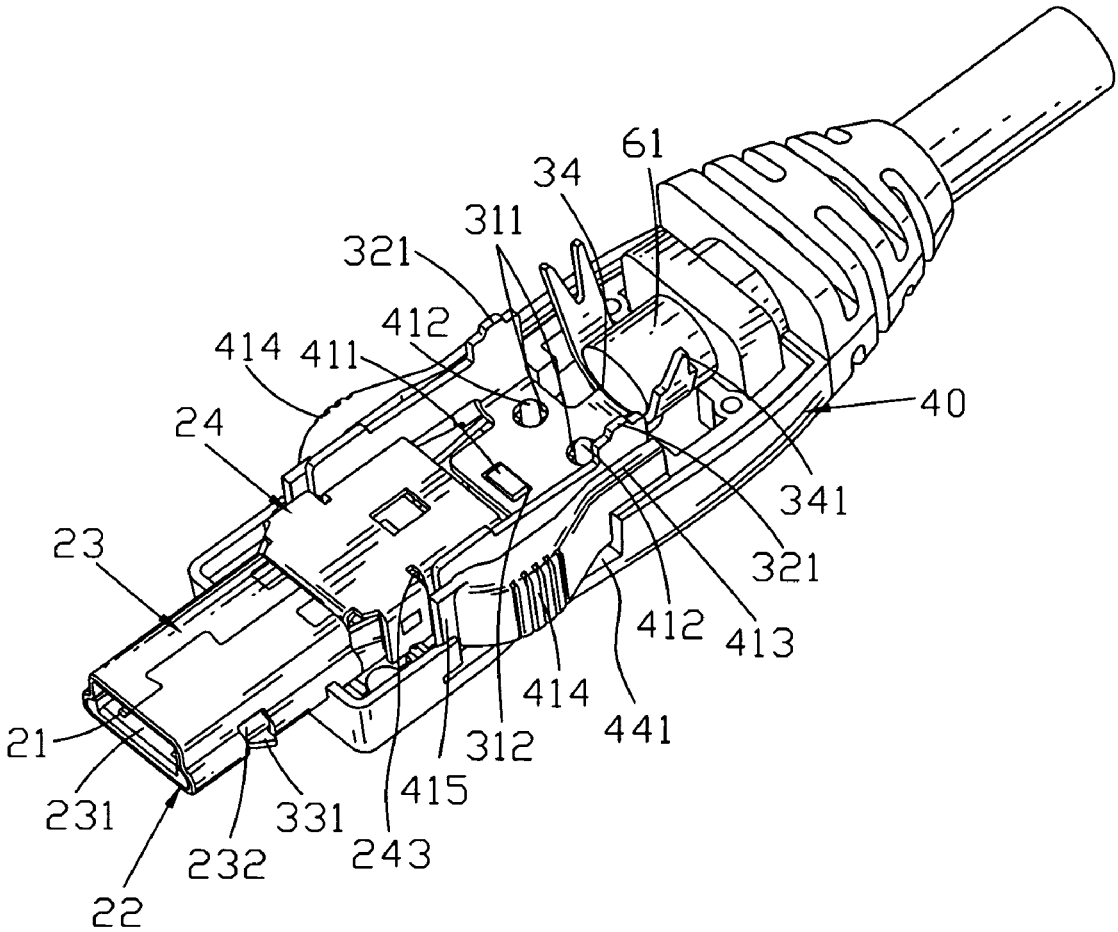
FIG. 5 is a perspective view of the plug connector without the upper plastic cover.
Figure 6:
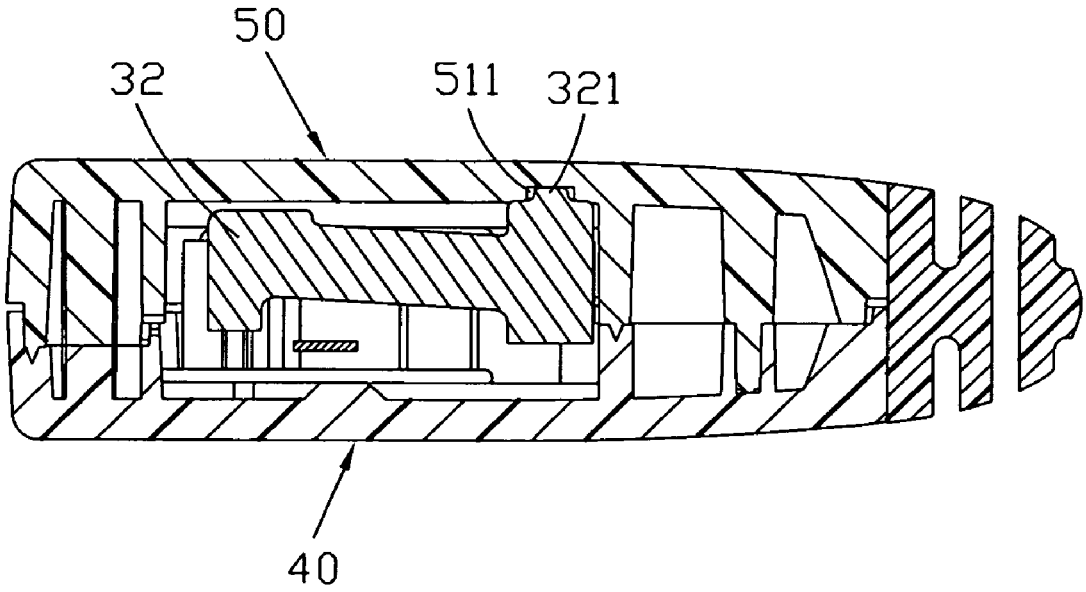
FIG. 6 is a cross-sectional view taken along line VI—VI of FIG. 1.

Referring to FIGS. 5 to 6, when the plug connector 1 is assembled, the front opening 521 of the upper plastic cover 50 and the front mouth 421 of the lower plastic cover 40 form a front mouth. The back opening 531 of the upper plastic cover 50 and the back mouth 431 of the lower plastic cover 40 form a back mouth. The button openings 541 of the upper plastic cover 50 and the button mouths 441 of the lower plastic cover 40 form button mouths. The mating portion 20 is fixed into the space made up of the upper plastic cover 50 and the lower plastic cover 40, and the bottom of the latch arm 244 touches the top surface of the basic plank 41 of the lower plastic cover 40. The front of the mating portion 20 stretches out of the front mouth. The hook apertures 232 are in front of the front mouth. The latch 30 is either fixed into the space. The restricting bulge 411 and the two blocking pillars 412 of the lower plastic cover 40 are inset correspondingly into the limiting hole 312 and the preventing holes 311 of the basic board 31 of the latch 30. The withstanding boards 512 of the upper plastic cover 50 block the rear of the latch 30, it avoiding the latch 30 removing. The locating bulges 321 of the barricades 32 of the latch 30 are inset in the locating cavities 511 of the upper plastic cover 50. The front and the rear of each barricade 32 get in touch with the inner surface of the steady board 413 and the touching board 415. The arms 33 pass through the opening bars 243 of the back shell 24 and are placed in both sides of the front shell 23. The hooks 331 are inserted into the hook apertures 232 and project outwardly. In this case, the hooks 331 may secure an external electrical device (not shown in figures) if the hooks 331 project outwardly from the hook apertures 232 at a natural free stage, or easily release the electrical device from the connection status by pressing the resilient buttons 414. The cable 60 is placed in the rear of the plastic covers. The plurality of conductive leads 61 are inset into the space made up of the two plastic covers and fastened by the immovable slice 34. The plurality of conductive leads 61 are respectively connected with the conductor pins 21 to conduct electricity. (not shown)

Although preferred embodiment of the present invention have been described in detail hereinabove, it should be clearly understand that many variations and/or modifications of the basic inventive concepts herein taught which may appear to those skilled in the present art will fall within the spirit and scope of the present invention, as defined in the appended claims.

What is claimed is:

1. A plug connector, comprising:

an upper plastic cover and a lower plastic cover, the plastic covers buckling with each other and forming a space, a mouth opened in a front of a plastic cover plank;

a mating portion, which is fixed into the space and stretches out of the mouth, including a plurality of conductor pins, a housing and a shell, the conductor pins inserted into the housing and the housing held in the shell, a hook aperture opened in each front of the shell; and a latch, which is fixed into the space, having a pair of barricades, the barricades stretching forward and forming two arms, the arms passing through both sides of the shell, each arm having a hook at the head, the hooks inserted into the hook apertures and projecting outwardly, wherein the barricades of the latch protruding upward and forming at least two locating bulges, correspondingly at least two locating cavities defined inside the top surface of the upper plastic cover, the locating bulges inserted into the locating cavities.

2. The plug connector as claimed in claim 1, wherein the latch has a basic board which is fastened into a basic plank of the lower plastic cover, the basic board stretching upward and forming a pair of barricades and the barricades stretching forward to the front of the basic board.

3. The plug connector as claimed in claim 2, wherein each barricade of the latch protrudes upward at the end of the top surface thereof and forms the locating bulge.

4. The plug connector as claimed in claim 1, wherein a bottom of the barricade extends sidelong a bit and then stretches forward to form the arm, each arm having a hook at the head.

5. The plug connector as claimed in claim 2, wherein the basic plank of the lower plastic cover stretches upward and forms a restricting bulge, correspondingly in the basic board of the latch, a limiting hole located on the basic board for matching the restricting bulge.

6. The plug connector as claimed in claim 2, wherein the basic plank of the lower plastic cover stretches upward and forms several blocking pillars, and several preventing holes are located on the basic board for matching the blocking pillars.

7. The plug connector as claimed in claim 1, wherein the shell includes a front shell and a back shell, the rear of the front shell stretching backward and forming a bottom board, the back shell having a top board, wherein each side of the top board bends vertically and forms a first side board, each rear of the first side board stretching downward and then extending forward and forming a latch arm, the latch arms which buckle with the rear of the bottom board of the front shell.

8. The plug connector as claimed in claim 1, further comprising a cable, placed in the end of the plastic covers, the cable having a plurality of conductive leads which are connected to the conductor pins.

9. The plug connector as claimed in claim 1, further comprising two buttons, located on the plastic covers, the hooks securing an external electrical device as the hooks project outwardly from the hook apertures at a natural free stage.

10. The plug connector as claimed in claim 9, wherein the electrical device is discharged from the hooks by pressing the resilient buttons.

11. The plug connector as claimed in claim 1, wherein the plug connector is a USB plug connector.

* * * * *